US008434256B2

(12) United States Patent
An

(10) Patent No.: US 8,434,256 B2
(45) Date of Patent: May 7, 2013

(54) APPARATUS FOR CLEANING GUN BARREL

(75) Inventor: Sang Jin An, Buk-gu (KR)

(73) Assignee: Soosung Machinery Co., Ltd., Ulsan (KR)

( * ) Notice: Subject to any disclaimer, the term of this patent is extended or adjusted under 35 U.S.C. 154(b) by 441 days.

(21) Appl. No.: 12/862,345

(22) Filed: Aug. 24, 2010

(65) Prior Publication Data

US 2011/0179592 A1 Jul. 28, 2011

(30) Foreign Application Priority Data

Jan. 27, 2010 (KR) ..... 10-2010-0007407

(51) Int. Cl.
*F41A 31/02* (2006.01)
*B08B 9/047* (2006.01)

(52) U.S. Cl.
USPC ..... 42/95; 15/104.05; 15/104.09

(58) Field of Classification Search ... 42/95; 15/104.05, 15/104.09
See application file for complete search history.

(56) References Cited

U.S. PATENT DOCUMENTS 7,520,082 B2 * 4/2009 An ..... 42/95
2005/0188598 A1 * 9/2005 Paananen et al. ..... 42/95
2006/0218735 A1 * 10/2006 Parker-Smith ..... 15/104.05
2007/0119007 A1 * 5/2007 Minshall ..... 15/104.09
2008/0229644 A1 * 9/2008 An ..... 42/95
2011/0119845 A1 * 5/2011 Kim ..... 15/104.05

* cited by examiner

*Primary Examiner* — J. Woodrow Eldred
(74) *Attorney, Agent, or Firm* — Flaster/Greenberg P.C.

(57) ABSTRACT

An apparatus for cleaning a gun barrel having striations formed on an inner surface of the gun barrel includes a cleaning means that is in contact with the inner surface of the gun barrel as being moved by a drive means installed inside a cylindrical main body. The cleaning means includes a main member having a circular plate on which a plurality of insertion holes is formed along its circumference; a rotating member formed inside the circular plate and having a motor and a rotating gear interlocking with the motor; and cleaning members formed to be inserted into the insertion holes, respectively, to clean the inner surface of the gun barrel and having lower sides interlocking with the rotating gear, respectively, to be rotated. The apparatus for cleaning a gun barrel is rotated at high speed with an appropriate pressure along the groove part of the gun barrel accurately, and thus a wide area can be cleaned in a short time. Even if the brusher is worn out, an appropriate pressure is maintained by the spring, and thus the amount of wear is compensated for. Since the brusher does not secede from the barrel, the accuracy is increased, and since the respective brushers are replaceable and it is not required to replace the whole cleaning member, the cost is saved.

8 Claims, 6 Drawing Sheets

APPARATUS FOR CLEANING GUN BARREL

CROSS-REFERENCE TO RELATED APPLICATIONS

This application is based on and claims priority from Korean Patent Application No. 10-2010-0007407, filed on Jan. 27, 2010 in the Korean Intellectual Property Office, the disclosure of which is incorporated herein in its entirety by reference.

BACKGROUND OF THE INVENTION

1. Field of the Invention

The present invention relates to an apparatus for cleaning a gun barrel, which can clean an inner surface of a gun barrel having striations separately for the respective striations.

2. Description of Related Art

After a shell is fired, alien substances produced due to the combustion of gun powder and ammunition are adhered to the inner surface of the gun barrel, and this lowers the accuracy of the shell being fired. Accordingly, after the gun barrel is used, the alien substances stuck on the inside of the gun barrel are removed and anti-corrosive oil is sprayed.

Typically, firearms having large-sized gun barrels such as self-propelled artilleries and towed howitzers are limited in disassembly, cleaning, and lubrication when they are repaired and maintained, as compared with common rifles which are individual carrying firearms.

In particular, the cleaning and washing of an inner surface of a gun barrel is performed in a manner that a brush is fixed to an end part of a connection rod, and the repetitive pushing/pulling operation of the connection rod into/from the gun barrel removes alien substances remaining in the gun barrel after firing. This cleaning process requires lots of hands and physical strength, and thus is hardly performed for many hours.

FIGS. 1 and 2 are cross-sectional views of apparatuses for automatically cleaning a gun barrel in the related art.

As illustrated in FIG. 1, one apparatus for automatically cleaning a gun barrel in the related art includes a drive unit 20, a cleaning unit 30 and a spray unit 40 which are installed between drive motors 20*a* and 20*b*. Another apparatus for automatically cleaning a gun barrel in the related art as illustrated in FIG. 2 includes a gear housing 50, a main shaft 60, a sun gear 70, a planet gear 80, and an external gear 90.

These cleaning apparatuses in the related art use a method of cleaning an inner surface of the gun barrel whereby the cleaning apparatus rotates or moves cleaning members provided thereon forward/backward as it enters along the inner surface of the gun barrel using the drive motors.

However, the above-described cleaning apparatuses in the related art have the drawbacks in that they are not effective in cleaning the inner surface of the gun barrel in the case where striations are formed on the inner surface of the gun barrel to give a rotating force to the fired shell.

Also, if the cleaning members which clean the inner surface of the gun barrel are worn out, the cleaning work is ineffectively performed.

Also, it is difficult to replace the cleaning members.

Also, if the cleaning members secede from the gun barrel, they may not be accurately restored to their original positions.

BRIEF SUMMARY OF THE INVENTION

Accordingly, the present invention has been made to solve the above-mentioned problems occurring in the related art while advantages achieved by the prior art are maintained intact.

One subject to be achieved by the present invention is to provide an apparatus for cleaning a gun barrel, which can effectively perform the cleaning work even if the cleaning members are worn out, which can facilitate the replacement of the cleaning members, and which can make the cleaning members be restored to their original positions even if the cleaning members secede from the gun barrel, thereby achieving the effective cleaning of the inner surface of the gun barrel.

In one aspect of the present invention, there is provided an apparatus for cleaning a gun barrel having striations formed on an inner surface of the gun barrel, including a cleaning means that is in contact with the inner surface of the gun barrel as being moved by a drive means installed inside a cylindrical main body, wherein the cleaning means includes a main member having a circular plate on which a plurality of insertion holes is formed along its circumference; a rotating member formed inside the circular plate and having a motor and a rotating gear interlocking with the motor; and cleaning members formed to be inserted into the insertion holes, respectively, to clean the inner surface of the gun barrel and having lower sides interlocking with the rotating gear, respectively, to be rotated.

The insertion holes may be formed in zigzag along the circumference in a double line.

The cleaning member may include a case having a spring provided therein; a brusher coupled to the spring to clean the inner surface of the gun barrel; a rotating shaft formed on a lower side of the case and inserted into the insertion hole; and a bevel gear coupled to a lower part of the rotating shaft and interlocking with the rotating gear to rotate the cleaning member.

The case may have an accommodation groove formed on a lower side thereof and may be attached/detached by a ball plunge mounted on the rotating shaft.

The case may further include an accommodation member accommodating the brusher in an inner periphery thereof on the upper side; wherein the brusher is formed on the accommodation member, and the spring is connected to a lower side of the accommodation member.

The accommodation member may be attached or detached by a fastening pin.

The rotating shaft may be further provided with a metal bearing formed on a side surface thereof, and adjustment members provided on upper and lower parts of the metal bearing so as to adjust the position of the case.

Guide rollers operated by the drive means may be further provided on front and rear sides of the cleaning means; and a position sensor is attached to one side of the guide roller; wherein in the case where the gun barrel cleaning apparatus secedes from a predetermined position, the position sensor transfers a signal to the drive means.

With the above-described construction according to an embodiment of the present invention, the apparatus for cleaning a gun barrel is rotated at high speed with an appropriate pressure along the groove part of the gun barrel accurately, and thus a wide area can be cleaned in a short time.

Also, even if the brusher is worn out, an appropriate pressure is maintained by the spring, and thus the amount of wear is compensated for.

Also, since the brusher does not secede from the barrel, the accuracy is increased.

Also, since the respective brushers are replaceable and it is not required to replace the whole cleaning member, the cost is saved.

BRIEF DESCRIPTION OF THE SEVERAL VIEWS OF THE DRAWING(S)

The above and other objects, features and advantages of the present invention will be more apparent from the following detailed description taken in conjunction with the accompanying drawings, in which.

DETAILED DESCRIPTION OF THE INVENTION

Hereinafter, a preferred embodiment of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

The construction and operation of an apparatus for cleaning a gun barrel according to embodiments of the present invention will now be described in detail with reference to the accompanying drawings.

Figure 1:
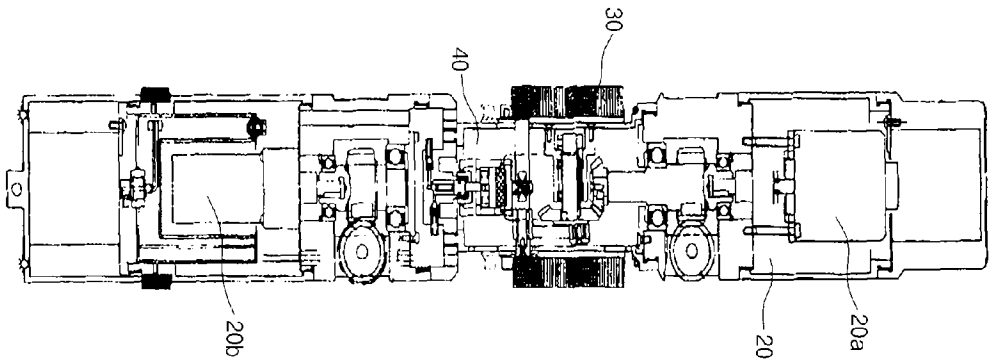
FIG. 1 Prior Art
FIG. 1 is a cross-sectional view of an apparatus for automatically cleaning a gun barrel in the related art.
Figure 2:
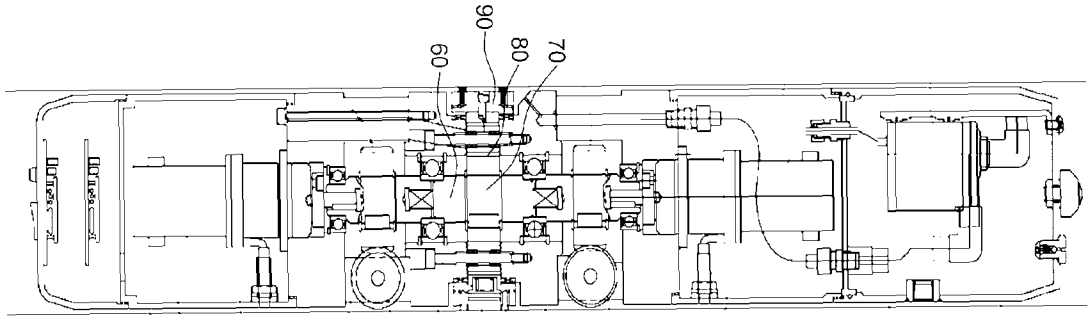
FIG. 2 Prior Art
FIG. 2 is a cross-sectional view of another apparatus for automatically cleaning a gun barrel in the related art.
Figure 3:
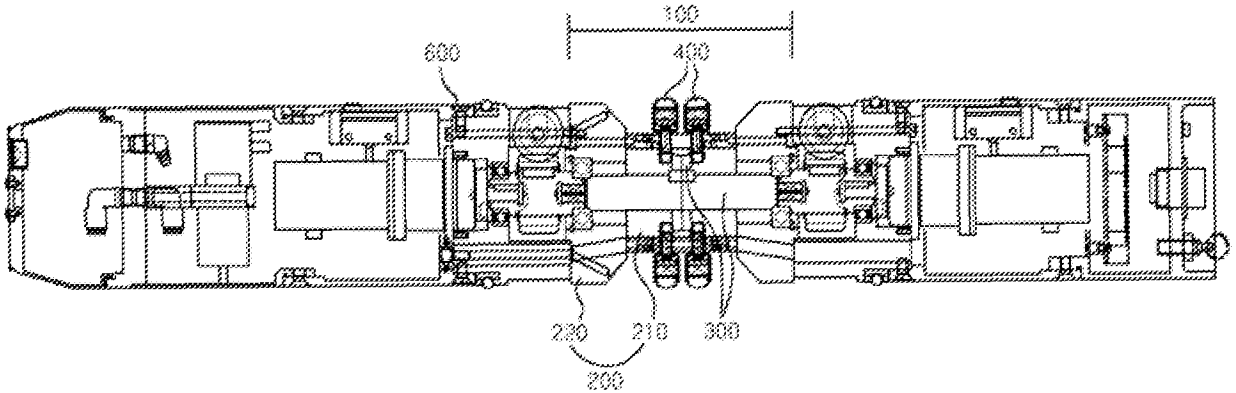
FIG. 3 is a cross-sectional view of an apparatus for cleaning a gun barrel according to an embodiment of the present invention.
Figure 4:
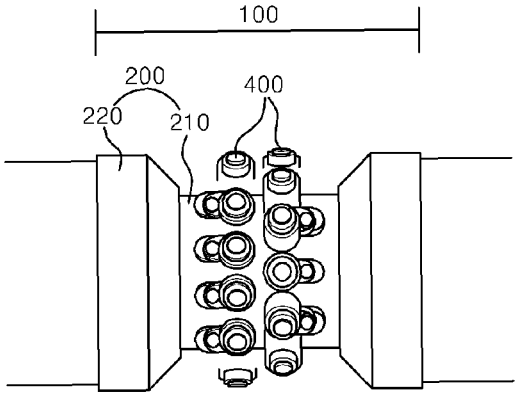
FIG. 4 is a partial cross-sectional view of a cleaning means according to an embodiment of the present invention.
Figure 5:
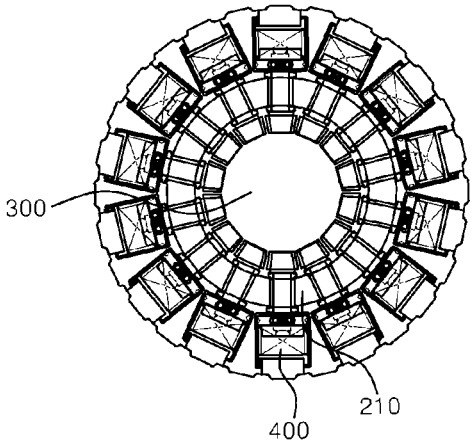
FIG. 5 is a partial cross-sectional view of a cleaning means according to an embodiment of the present invention.
Figure 6:
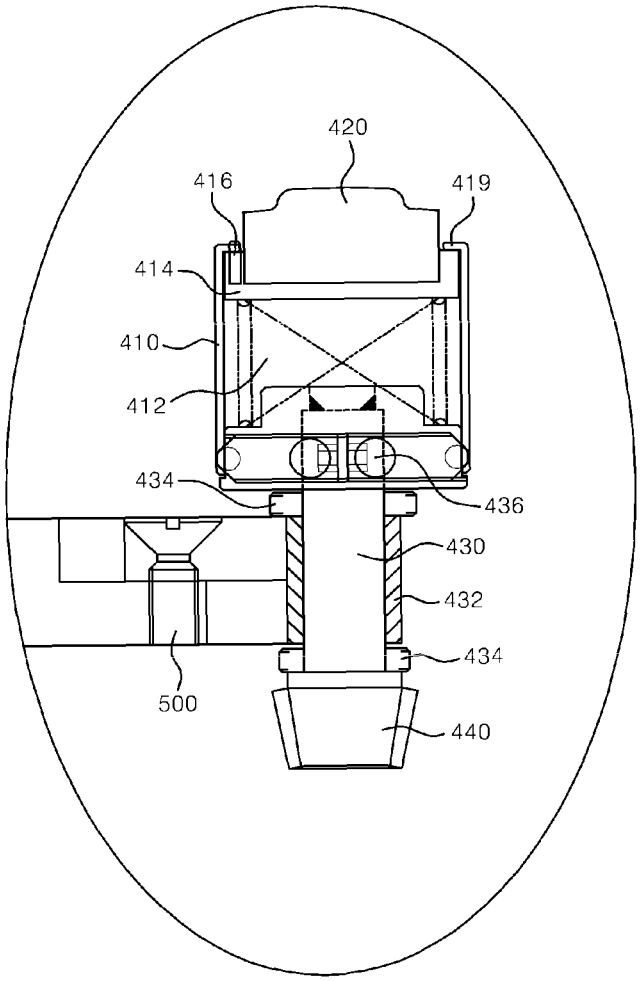
FIG. 6 is a cross-sectional view of a cleaning member according to an embodiment of the present invention.
Figure 7:
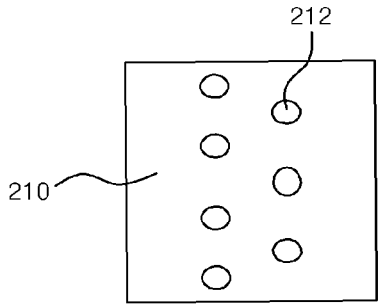
FIG. 7 is a cross-sectional view of the circumference of a circular plate according to an embodiment of the present invention.
Figure 8:
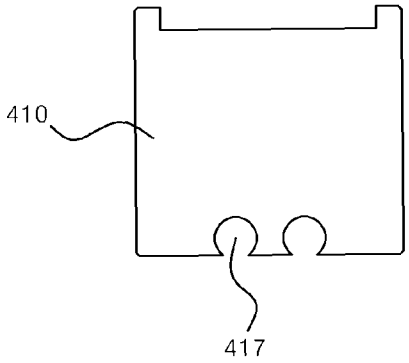
FIG. 8 is a cross-sectional view of a bottom surface of a case according to an embodiment of the present invention.

FIG. 3 is a cross-sectional view of an apparatus for cleaning a gun barrel according to an embodiment of the present invention. FIG. 4 is a partial cross-sectional view of a cleaning means according to an embodiment of the present invention, FIG. 5 is a partial cross-sectional view of a cleaning means according to an embodiment of the present invention, and FIG. 6 is a cross-sectional view of a cleaning member according to an embodiment of the present invention. FIG. 7 is a cross-sectional view of the circumference of a circular plate according to an embodiment of the present invention, and FIG. 8 is a cross-sectional view of a bottom surface of a case according to an embodiment of the present invention.

First, according to an embodiment of the present invention, a cleaning means 100 is coupled to a circular main body having a conventional drive means (not illustrated). The drive means (not illustrated) includes wheels coupled to a drive motor to move the circular main body along the inner surface of the gun barrel. To the rear end part of the circular main body, a controller for controlling a cleaning means 100 may be coupled, or an oil tank and an oil pump may be coupled for a smooth cleaning operation.

Also, the oil tank for storing cleaning solution or anti-corrosive oil is installed in the front part of the main body, and the oil pump sprays the cleaning solution or anti-corrosive oil through a spray orifice formed adjacent to the cleaning means 100 and toward the inner surface of the gun barrel at a specified angle. However, the detailed explanation thereof will be omitted.

As illustrated in FIGS. 3 to 8, the cleaning means 100 includes a main member 200 having a circular plate 210 on which a plurality of insertion holes 212 is formed along its circumference; a rotating member 300 formed inside the circular plate 210 and having a motor (not illustrated) and a rotating gear 300 interlocking with the motor; and cleaning members 400 formed to be inserted into the insertion holes 212, respectively, to clean the inner surface of the gun barrel and having lower sides interlocking with the rotating gear 300, respectively, to be rotated.

Hereinafter, the detailed construction of the cleaning means will be described in detail.

In an embodiment of the present invention, the main member 200 has the circular plate 210 that is tilted to correspond to the slope of striations formed on the inner surface of the gun barrel.

The circular plate 210 has a predetermined width, and the plurality of insertion holes 212 is formed along the circumference of the circular plate 210. In accordance with the kinds of guns, the number of insertion holes 212 is changed. In the case of a 155 mm gun, 48 right-inclined striations are formed and thus 48 insertion holes 212 are required, while in the case of a 105 mm gun, 24 right-inclined striations are formed and thus 24 insertion holes 212 are required.

Preferably, the insertion holes 212 are arranged in zigzag along the circumference in a double line. That is, for a smooth rotation of the cleaning members 400, the first line of the insertion holes is positioned on an odd-numbered striation and the second line of the insertion holes is positioned on an even-numbered striation, so that the rotational interference is avoided.

The circular plate 210 has a hollow space part formed therein, and the rotating member 300 to be described later is installed therein.

The main member 200 is provided with a connection member 220 for connecting the circular plate 210 to the apparatus for cleaning the gun barrel, and a drive force of the drive means (not illustrated), a power, and the like, are transferred through the connection member 220.

In an embodiment of the present invention, the rotating member 300 is formed in the hollow space part inside the circular plate 210, and includes a motor and a rotating gear 300 interlocking with the motor.

Here, the power of the motor is supplied through the connection member 400.

The rotating gear is a well-known gear set for rotating cleaning members 400, respectively, to be described later, and thus the detailed description thereof will be omitted. That is, the rotating gear 300 is constructed to make it possible to rotate respective bevel gears 440 of the cleaning members 400, and the multi-stage gear construction is well known in the art.

In an embodiment of the present invention, the cleaning members 400 are formed to be inserted into the insertion holes 212, respectively, to clean the inner surface of the gun barrel and have lower sides interlocking with the rotating gear 300, respectively.

Accordingly, if the rotating gear 300 is operated by the driving of the motor, the cleaning members 400 are individually rotated to clean the inner surface of the gun barrel.

Preferably, the cleaning member 400 includes a case 410 having a spring 412 provided therein; a brusher 420 coupled to the spring 412 to clean the inner surface of the gun barrel; a rotating shaft 430 formed on a lower side of the case 410 and inserted into the insertion hole; and a bevel gear 440 coupled to a lower part of the rotating shaft 430 and interlocking with the rotating gear 300 to rotate the cleaning member.

The case 410 is provided with a spring 412 which is made of a steel material having high strength and hardness and is compressed and decompressed in the case 410.

Also, the case 410 is in the form of a cylinder, and has an upper part that is open and a lower part that is partially or entirely closed to mount the spring 412 therein.

Here, the brusher 420 is inserted into the upper side of the case 410, and is coupled to the upper side of the spring 412. The brusher 420 is made of a synthetic resin material, and is in direct contact with the inner surface of the gun barrel during cleaning. The brusher 420 is worn out with the lapse of time.

In particular, the brusher 420 is initially put to compress the spring, and as the brusher is worn out, the spring is released 412, so that the brusher cleans the inner surface of the gun barrel under the same condition.

Here, the rotating shaft 430 is a part that is coupled to the lower side of the case 410, and is inserted into the insertion hole 212. That is, the diameter of the rotating shaft 430 is smaller than the diameter of the insertion hole 212, and thus the rotating shaft 430 is inserted into the insertion hole 212. Also, the rotating shaft 430 connects the bevel gear 440 to the case 410, and by the operation of the rotating gear 300 interlocking with the bevel gear 440, the case 410 and the brusher 420 are rotated.

The bevel gear 440 interlocks with the rotating gear 300, and by the operation of the rotating gear 300, the rotating direction of the bevel gear 440 is changed to rotate the rotating shaft 430 and the brusher 420 in order.

Preferably, the case 410 has an accommodation groove 417 formed on the lower side thereof, and is attached/detached by a ball plunge 436 mounted on the rotating shaft 430.

The case 410 has a closed lower side, and the accommodation groove 417 in the form of a sphere is formed on the lower surface of the case. On the upper side of the rotating shaft 430, a ball plunger 436 having a size larger than that of the accommodation groove 417 is formed, and is coupled to the ball plunge 436 and the accommodation groove 417 in a tight insertion manner.

Accordingly, the case 410 can be easily replaced.

Preferably, the case 410 is further provided with an accommodation member 414 accommodating the brusher 420 in an inner periphery thereof on the upper side. The brusher 420 is formed on the accommodation member 414, and the spring 412 is formed on the lower side of the accommodation member 414.

The brusher 420 is made of a synthetic resin, and it is difficult that the brusher 420 is directly coupled to the spring made of a still material. Accordingly, the accommodation member 414 is in the form of a bowl, and accommodates the brusher 420 therein. On the lower side of the accommodation member 414, the spring 412 is formed. Also, a stepped portion 419 is formed from the upper edge to the lower side of the case 410 to prevent the accommodation member 414 from seceding from the case 410.

The accommodation member 414 is attached or detached by the fastening pin 416, and this is to facilitate the replacement of brusher 420 when the brusher 420 is worn out.

Accordingly, the fastening pin 416 is coupled to the accommodation member 414 through the stepped portion 419. On the other hand, the accommodation member 414 is separated by removing the fastening pin 416 and slantingly pressing the accommodation member 414 in a downward direction to separate the accommodation member 414. On the other hand, the groove that corresponds to the stepped portion 419 is formed in side-surface direction, and the accommodation member 414 is separated by removing the fastening pin 416, rotating the accommodation member 414, and making the groove coincide with the stepped portion 419.

Preferably, the metal bearing 432 is formed on the side surface of the rotating shaft 430, and adjustment members 434, which can adjust the position of the case 410, are further provided on upper and lower parts of the metal bearing 432. The metal bearing 432 is to make the rotating shaft 430 rotate as being fixed to a predetermined position, and the adjustment members 434 are formed on the upper and lower parts of the metal bearing 432 to function as rings that strongly connect the lower surface of the case 410 to the upper side of the rotating shaft 430 and the upper side of the bevel gear 440 to the lower side of the rotating shaft 430, respectively. That is, the adjustment members 434 are connection rings. Typically, collars are used as the adjustment members 434, and the collars mean connection rings which are put to connect or strengthen a pipe or the like.

Preferably, guide rollers 600 are further provided on front and rear sides of the cleaning means 100, and a position sensor (not illustrated) is attached to one side of the guide rollers 600. If the gun barrel cleaning apparatus secedes from the predetermined position, the position sensor (not illustrated) transfers a signal to the drive means (not illustrated).

The guide rollers 600 are auxiliary transfer rollers which are positioned on the front and rear sides of the position where the cleaning means 100 is formed, and are operated when the gun barrel cleaning apparatus secedes from the predetermined position. Of course, it is separate from a main roller for transferring the gun barrel cleaning apparatus forward and rearward.

Accordingly, the position sensor (not illustrated) is installed on one side of the guide roller to recognize whether the guide rollers 600 secede from the inner surface of the gun barrel for a predetermined distance. The position sensor (not illustrated) compares input distance values, and if the sensed distance exceeds the predetermined distance, it transfers the signal to the drive means (not illustrated), and the guide rollers 600 are operated to restore the apparatus to its original position.

Next, an embodiment according to the present invention will be described.

First, a user inserts the gun barrel cleaning apparatus according to the present invention into the gun barrel, and moves the apparatus to the inside of the gun barrel. Accordingly, the gun barrel cleaning apparatus is guided along the striations on the inner surface of the gun barrel.

The cleaning means 100 may be individually formed in accordance with the number of striations on the inner surface of the gun barrel to perform the cleaning operation.

Accordingly, if the apparatus reaches the cleaning position on the inner surface of the gun barrel, the motor of the rotating member 300 is rotated, and the brusher 420 that is in contact with the inner surface of the gun barrel is rotated to perform the cleaning operation. Here, if the brusher 420 is worn out, the compressed spring 412 restores the brusher 420 in the upward direction to correspond to the worn-out of the brusher 420, and thus the cleaning is performed under the same condition.

If the brusher 420 is completely worn out and the replacement thereof is required, the fastening pin 416 is separated to take out the accommodation member 414 from the case, and the brusher 420 is replaced. Also, in the case of replacing the case 410 and the spring 412 due to the aging thereof, one-touch replacement thereof is possible since they are tightly inserted by the ball plunge 436.

In summary, with the rotation of the motor, the rotating gear, the bevel gear 440, and the rotating shaft 430 are operated to make the brusher rotate at high speed of about 1278 rpm. Accordingly, about 200 times the cleaning effects and 5 times the cleaned state can be obtained in comparison to the manual cleaning of the inner surface of the gun barrel.

As described above, the gun barrel cleaning apparatus according to the present invention performs a cleaning work in a manner that the striations on the inner surface of the gun barrel are respectively cleaned. Although preferred embodiments of the present invention have been described for illustrative purposes, those skilled in the art will appreciate that various modifications, additions and substitutions are possible, without departing from the scope and spirit of the invention as disclosed in he accompanying claims.

What is claimed is:

1. An apparatus for cleaning a gun barrel having striations formed on an inner surface of the gun barrel, including a cleaning means that is in contact with the inner surface of the gun barrel as being moved by a drive means installed inside a cylindrical main body, wherein the cleaning means comprises:

a main member having a circular plate on which a plurality of insertion holes is formed along its circumference;

a rotating member formed inside the circular plate and having a motor and a rotating gear interlocking with the motor; and cleaning members formed to be inserted into the insertion holes, respectively, to clean the inner surface of the gun barrel and having lower sides interlocking with the rotating gear, respectively, to be rotated.

2. The apparatus of claim 1, wherein the insertion holes are formed in zigzag along the circumference in a double line.

3. The apparatus of claim 1, wherein the cleaning member comprises:

a case having a spring provided therein;

a brusher coupled to the spring to clean the inner surface of the gun barrel;

a rotating shaft formed on a lower side of the case and inserted into the insertion hole; and a bevel gear coupled to a lower part of the rotating shaft 430 and interlocking with the rotating gear to rotate the cleaning member.

4. The apparatus of claim 3, wherein the case has an accommodation groove formed on a lower side thereof and is be attached or detached by a ball plunge mounted on the rotating shaft.

5. The apparatus of claim 3, wherein the case further comprises an accommodation member accommodating the brusher in an inner periphery thereof on the upper side;

wherein the brusher is formed on the accommodation member, and the spring is connected to a lower side of the accommodation member.

6. The apparatus of claim 5, wherein the accommodation member is attached or detached by a fastening pin.

7. The apparatus of claim 3, wherein the rotating shaft is provided with a metal bearing formed on a side surface thereof, and adjustment members provided on upper and lower parts of the metal bearing so as to adjust the position of the case.

8. The apparatus of claim 1, further comprising:

guide rollers operated by the drive means provided on front and rear sides of the cleaning means; and a position sensor attached to one side of the guide roller;

wherein in the case where the gun barrel cleaning apparatus secedes from a predetermined position, the position sensor transfers a signal to the drive means.

* * * * *